US008740731B2

(12) United States Patent
Miller et al.

(10) Patent No.: US 8,740,731 B2
(45) Date of Patent: Jun. 3, 2014

(54) TRAINING DEVICE AND METHOD OF USING THE SAME

(76) Inventors: Brad Miller, Holliston, MA (US); John Miller, Holliston, MA (US)

( * ) Notice: Subject to any disclaimer, the term of this patent is extended or adjusted under 35 U.S.C. 154(b) by 282 days.

(21) Appl. No.: 13/373,461

(22) Filed: Nov. 15, 2011

(65) Prior Publication Data

US 2012/0214621 A1 Aug. 23, 2012

Related U.S. Application Data

(60) Provisional application No. 61/463,705, filed on Feb. 22, 2011.

(51) Int. Cl.
*A63B 69/00* (2006.01)
*A63B 6/00* (2006.01)

(52) U.S. Cl.
CPC ..... *A63B 69/0002* (2013.01); *A63B 6/00* (2013.01); *A63B 2069/0006* (2013.01)
USPC ..... 473/452; 473/422; 473/451

(58) Field of Classification Search
CPC ..... A63B 69/0002; A63B 69/00; A63B 2243/0008; A63B 2243/0004
USPC ..... 473/422, 451, 452, 266, 269, 270; D21/688, 780; 482/71, 80, 79
See application file for complete search history.

(56) References Cited

U.S. PATENT DOCUMENTS

| | | | | | |
|---|---|---|---|---|---|
| 3,913,951 | A * | 10/1975 | LeFebvre, Jr. | 285/223 |
| 3,955,821 | A * | 5/1976 | Spedding | 473/271 |
| 4,023,810 | A * | 5/1977 | Lorang | 473/218 |
| 4,037,847 | A * | 7/1977 | Lorang | 473/269 |
| 4,694,684 | A * | 9/1987 | Campbell, III | 482/80 |
| 5,318,290 | A * | 6/1994 | Sawyer | 473/217 |
| 5,328,421 | A * | 7/1994 | Stanalajczo | 482/34 |
| 5,435,320 | A * | 7/1995 | Seitz | 600/595 |
| D383,510 | S * | 9/1997 | Bernardson | D21/688 |
| 5,810,673 | A * | 9/1998 | Castleberry | 473/217 |
| 6,001,026 | A * | 12/1999 | Breneman | 473/261 |
| 6,422,872 | B1 * | 7/2002 | Outlaw | 434/247 |
| 7,488,265 | B2 * | 2/2009 | Miller et al. | 473/452 |
| 8,460,132 | B2 * | 6/2013 | Miller et al. | 473/452 |
| 8,517,853 | B2 * | 8/2013 | Miller et al. | 473/270 |
| 2012/0021854 | A1 * | 1/2012 | Miller et al. | 473/451 |

* cited by examiner

*Primary Examiner* — Mitra Aryanpour
(74) *Attorney, Agent, or Firm* — Kriegsman & Kriegsman

(57) ABSTRACT

A training device includes a plate assembly pivotally connected to a support member. The plate assembly includes an angled top plate that is removably mounted onto a flat balance plate. The support member includes a rectangular mounting bracket that is transversely disposed across an enlarged base, the balance plate directly teetering on the mounting bracket. In use, the training device can be used to train a hitter to maximize lower body power using sensory and auditory feedback. Specifically, the hitter centers his rear foot on the angled top plate which promotes weight loading on the inner portion of the rear leg. The hitter then initiates the hitting process by driving the lower body forward until the balance plate pivots forward and strikes the base, thereby providing the user with audible and tactile response. This lower body drive creates significant momentum that powers rotation of the bat through the hitting zone.

14 Claims, 10 Drawing Sheets

TRAINING DEVICE AND METHOD OF USING THE SAME

CROSS-REFERENCE TO RELATED APPLICATIONS

The present application claims the benefit under 35 U.S.C. 119(e) of U.S. provisional Patent Application Ser. No. 61/463,705, filed Feb. 22, 2011, the disclosure of which is incorporated herein by reference.

BACKGROUND OF THE INVENTION

The present invention relates generally to athletic training devices and more particularly to training devices designed to promote the utilization of proper mechanics when hitting a baseball.

A hitter is required to engage in a well-timed and fluid sequence of interrelated actions in order to hit a baseball, softball or the like in a technically sound manner. Specifically, a technically proper swing requires that the hitter first set-up in a loaded, or ready, position. With the hitter positioned sideways, eyes directed forward and body coiled so as to hold the hands (and bat) behind the hitting zone, the hitter initially adjusts his body so that his center of gravity aligns with the inner portion of his rear leg. In this capacity, the majority of the weight of the hitter is effectively loaded in the inner portion of his rear hip, leg and foot (this condition being referred to herein as "inner rear loading" in the art).

To initiate the hitting process, the hitter utilizes a quick explosion of lower body power to advance his center of gravity linearly forward from the inner portion of his rear hip, leg and foot, this movement typically being accompanied by a forward slide, or stride, of the front foot. Through this quick weight transfer, the rear hip and knee of the hitter move linearly forward to a position in front of the back foot and thereby dispose the hitter in an "attack" position (this lower body power move being referred to herein as the "linear power move" or simply the "linear component" of a technically proper hitting swing.)

Immediately after execution of the linear component, the core of the hitter's body rapidly uncoils. More specifically, the acceleration of the hitter's body weight linearly forward powers the rapid rotation of the hips, torso, shoulders, arms and hands of the hitter as part of a kinetic chain of movement (this core, or upper body, movement being referred to herein as the "rotational chain of movement" or simply the "rotational component" of a technically proper hitting swing). This rapid rotation of the hitter's body drives the bat through the hitting zone with considerable acceleration which, in turn, enables the ball to be struck, or hit, with maximum force, which is highly desirable.

As can be appreciated, the utilization of proper mechanics when hitting a baseball is highly encouraged. The use of proper hitting mechanics serves to, among other things, (i) maximize bat speed through the hitting zone and thereby improve performance, and (ii) minimize stress on the hitter's upper body as it uncoils by relying, in part, on lower body muscular power, thereby reducing the likelihood of injury.

Although proper hitting mechanics are well known in the art, hitters nonetheless regularly exhibit a number of common mechanical flaws. In particular, it has been found that hitters commonly mistime or inadequately execute the linear component of a technically proper hitting swing. As noted above, the linear component of the swing, which is executed primarily using the hitter's lower body, is responsible for fueling, or driving, the rotational component of the swing, thereby maximizing bat speed and power through the hitting zone. However, it has been found that certain hitters are prone to initiate the hitting process using either (i) a rearward, or backward, weight shift, (ii) a minimal, or insufficient, linear power move, or (iii) a rotational chain of movement (i.e., by skipping the linear component of the swing altogether). As can be appreciated, failure to initiate the hitting process using the linear power move has been found to significantly limit the power generated during the rotational chain of movement.

Traditionally, hitters rely on instructors and/or video equipment to monitor the extent that hitters initiate the hitting process using a linear power move. Although useful, instructors and/or video equipment are not always readily available for a hitter and, in addition, can be relatively expensive in nature.

Accordingly, portable baseball training devices are well known in the art and are commonly used by players to improve performance. For example, in U.S. Pat. No. 7,488,265 to B. Miller et al., the disclosure of which is incorporated by reference, there is shown a training device for throwing a baseball that includes a plate assembly pivotally connected to a support member. The plate assembly includes a flat, rectangular balance plate and a sleeve disposed transversely across the bottom surface of the balance plate. The support member includes an elongated support arm on which the sleeve is adapted to teeter and a generally T-shaped strike plate connected to the support arm. In use, the training device can be used in the following manner to train a pitcher to exert maximum rear leg drive while throwing a baseball. Specifically, the training device is disposed on a flat, level flooring surface such that the plate assembly teeters on the support member. The pitcher then centers his rear foot on the balance plate and lifts his front knee. At this time, the pitcher drives his rear knee forward until the balance plate pivots forward and contacts the strike plate which in turn generates an audible signal. With the majority of the body weight of the pitcher displaced behind his rear knee, the pitcher begins his delivery. Because the pitcher is able to use the majority of his body weight to power his delivery, the pitcher is able to throw the baseball with greater velocity and with less strain exerted on his pitching arm.

Although well known and widely used in the art, baseball training devices of the type described above are designed to teach and train the proper mechanics associated with pitching a baseball. However, as can be appreciated, the conditions and particular mechanics associated with throwing a ball are considerably different than the conditions and mechanics associated with hitting a ball. For example, baseball training devices of the type as described above are typically constructed with a considerable height component in order to simulate some of the rise associated with a pitching mound (i.e., with the balance plate disposed over 1 inch above the strike plate). By comparison, a hitter traditionally stands on a flat, level surface when batting. As a result, high profile training devices of the type as described above are not well-suited for use in teaching proper swing mechanics.

SUMMARY OF THE INVENTION

It is an object of the present invention to provide a novel training device for hitting a baseball, softball or the like.

It is another object of the present invention to provide a training device as described above that is designed to train a hitter to initiate the hitting process using a forward linear lower body power move.

It is still another object of the present invention to provide a training device as described above that has a limited number of parts, is inexpensive to manufacture, is easy to use and is highly portable in nature.

Accordingly, as one feature of the present invention, there is provided a training device, the training device comprising (a) a plate assembly, and (b) a support member to which the plate assembly is pivotally coupled, the plate assembly being naturally biased to balance on the support member along a generally horizontal plane in the absence of a force applied thereto, (c) wherein at least a portion of the top profile of the plate assembly lies in a non-parallel relationship relative to the generally horizontal plane when the plate assembly is balanced on the support member.

As another feature of the present invention, there is provided a method of training a hitter to hit a ball using proper mechanics, the method comprising the steps of (a) providing a training device that comprises a plate assembly and a support member that are pivotally coupled together, the plate assembly comprising a balance plate and an angled top plate that is removably mounted on the balance plate, the balance plate being adapted to teeter forward and rearward on the support member, (b) placing the dominant foot of the hitter transversely across the angled top plate, (c) positioning the non-dominant foot of the hitter in front of the balance plate, (d) loading the weight of the hitter rearward into the inner portion of the dominant hip, leg and foot of the hitter, (e) transferring the weight of the hitter linearly forward such that the plate assembly pivots forward and contacts the support member, and (f) after the transferring step, rotationally driving the hips and torso of the hitter to swing the bat and hit the ball.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:

FIG. 4(*b*) is a top plan view of the top plate shown in FIG. 4(*a*);

FIG. 4(*c*) is a section view of the top plate shown in FIG. 4(*b*), taken along lines 4*c*-4*c*.

DETAILED DESCRIPTION OF THE PREFERRED EMBODIMENT

Figure 1A:
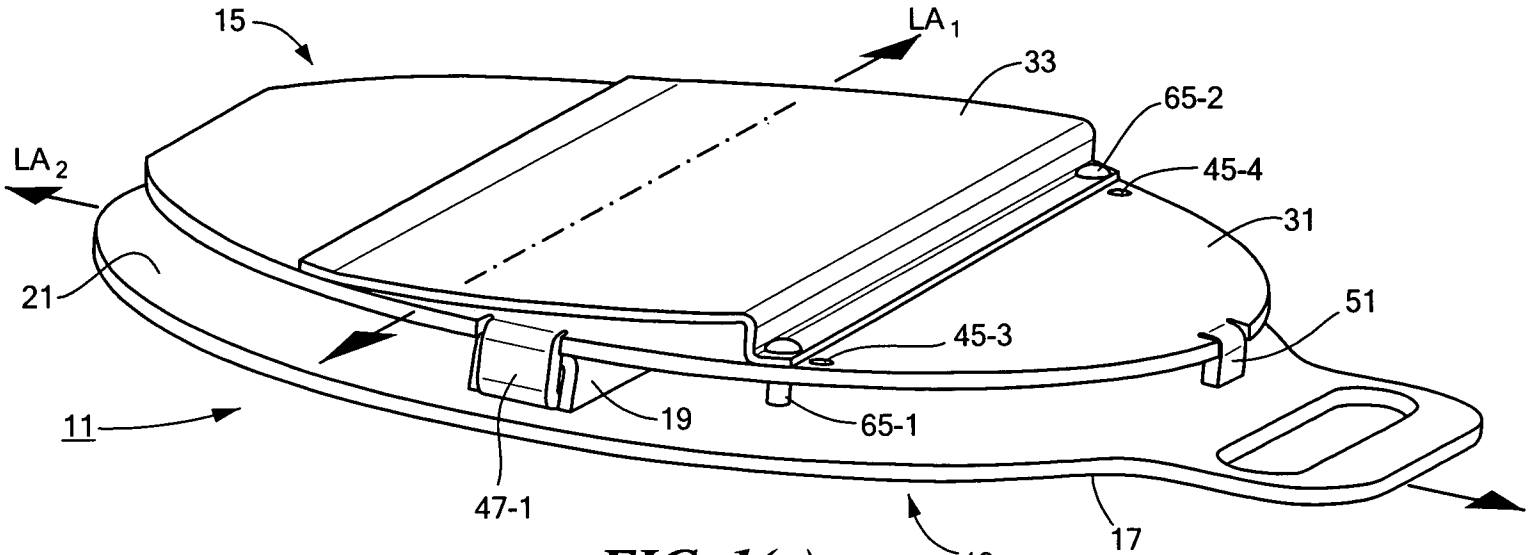
FIGS. 1(*a*)-(*d*) are top perspective, front plan, top plan and right end views, respectively, of a training device constructed according to the teachings of the present invention, FIG. 1(*d*) being broken away in part to view the transverse channel defined in the support member.
Figure 1B:
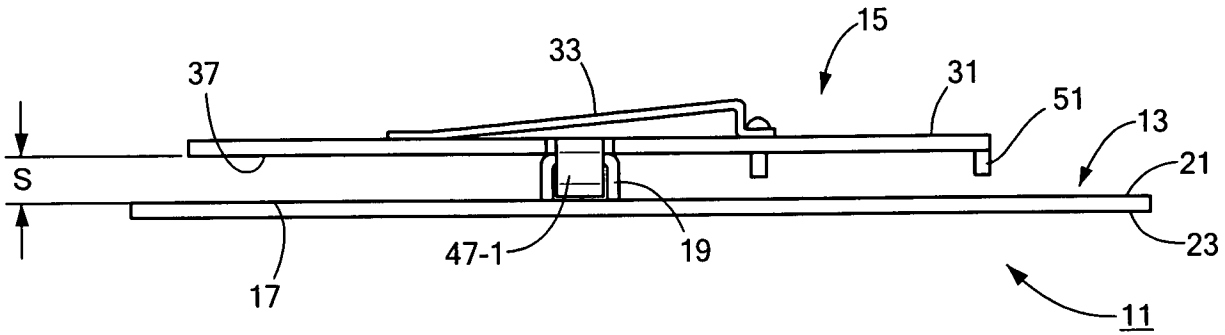
Figure 1C:
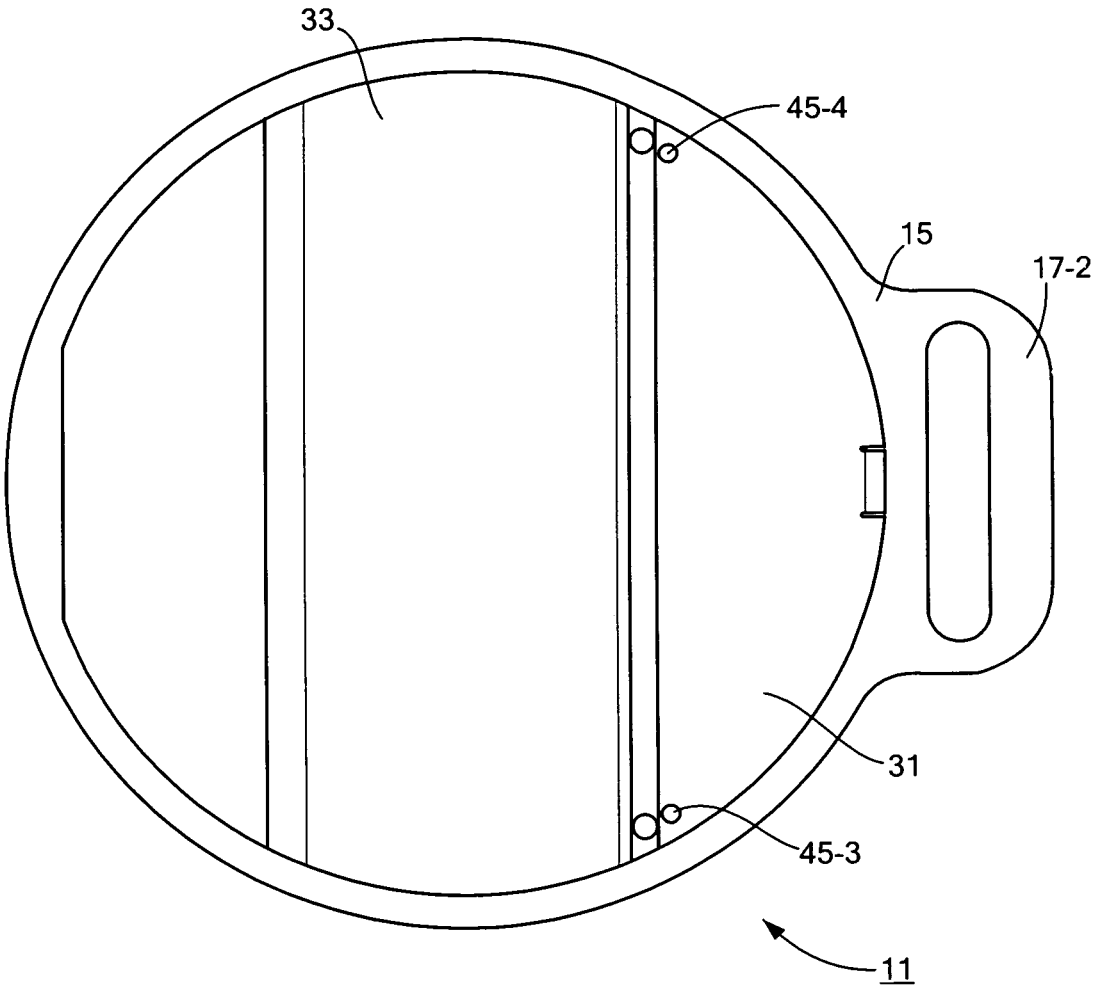
Figure 1D:
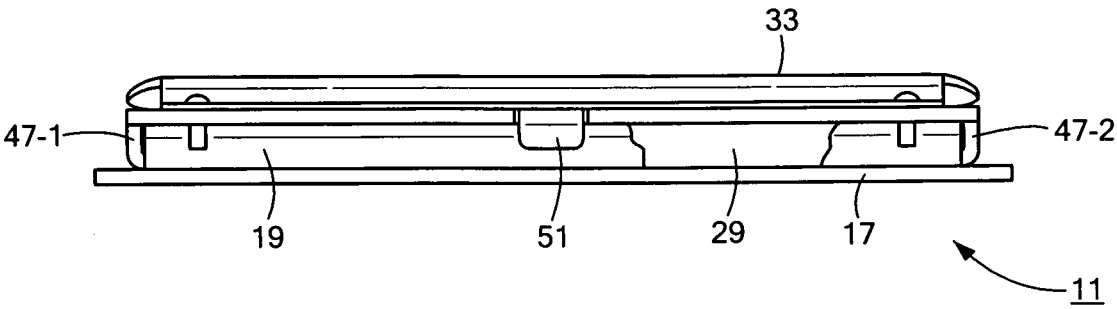

Referring now to FIGS. 1(*a*)-(*d*), there are shown top perspective, front plan, top plan and right end views, respectively, of a training device constructed according to the teachings of the present invention, the training device being identified generally by reference numeral 11. As will be described further in detail below, training device 11 is designed principally to promote the utilization of proper mechanics when hitting a baseball and, more specifically, to initiate the process of hitting a baseball by transferring body weight forward along a generally linear path, which is a principal object of the present invention.

For purposes of simplicity only, training device 11 is described herein as being used as an aid for teaching proper weight distribution during the process of hitting a baseball. However, it is to be understood that training device 11 is not limited to use in connection with hitting a baseball. Rather, it is to be understood that training device 11 could be used in any sports training application that requires means for sensing weight distribution during the process of hitting or striking an object (e.g., in connection with softball, golf, hockey, tennis or other similar sports activities).

Training device 11 comprises a support member 13 onto which is pivotally coupled a plate assembly 15. As will be described in detail below, plate assembly 15 is designed to support the rear foot of the user during the hitting process. Accordingly, it is to be understood that plate assembly 15 is adapted to teeter forward or rearward in response to the transfer of weight by the hitter, thereby providing the hitter with immediate detectable feedback.

Support member 13 comprises an enlarged base 17 and a transverse mounting bracket, or fulcrum, 19. For simplicity purposes only, base 17 and bracket 19 are represented as two separately constructed pieces that are subsequently joined together (e.g., through spot welding). However, it is to be understood that support member 13 could be alternatively constructed as a unitary member without departing from the spirit of the present invention.

Figure 2B:
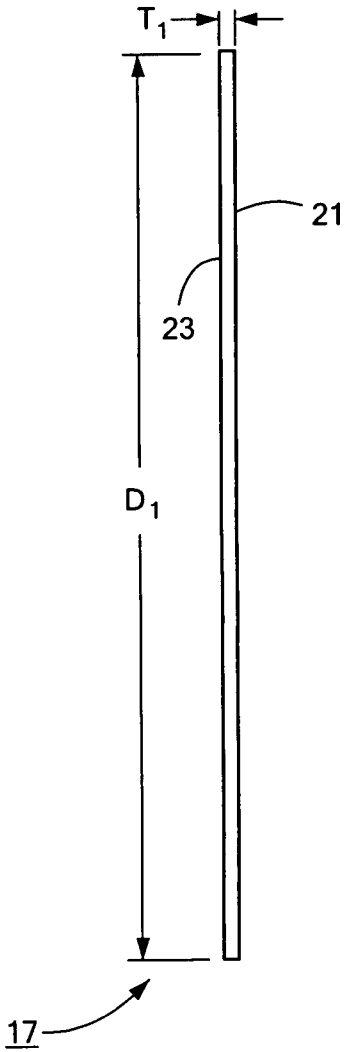
FIGS. 2(*a*)-(*b*) are top plan and left end views, respectively, of the base shown in FIG. 1(*a*)
Figure 2A:
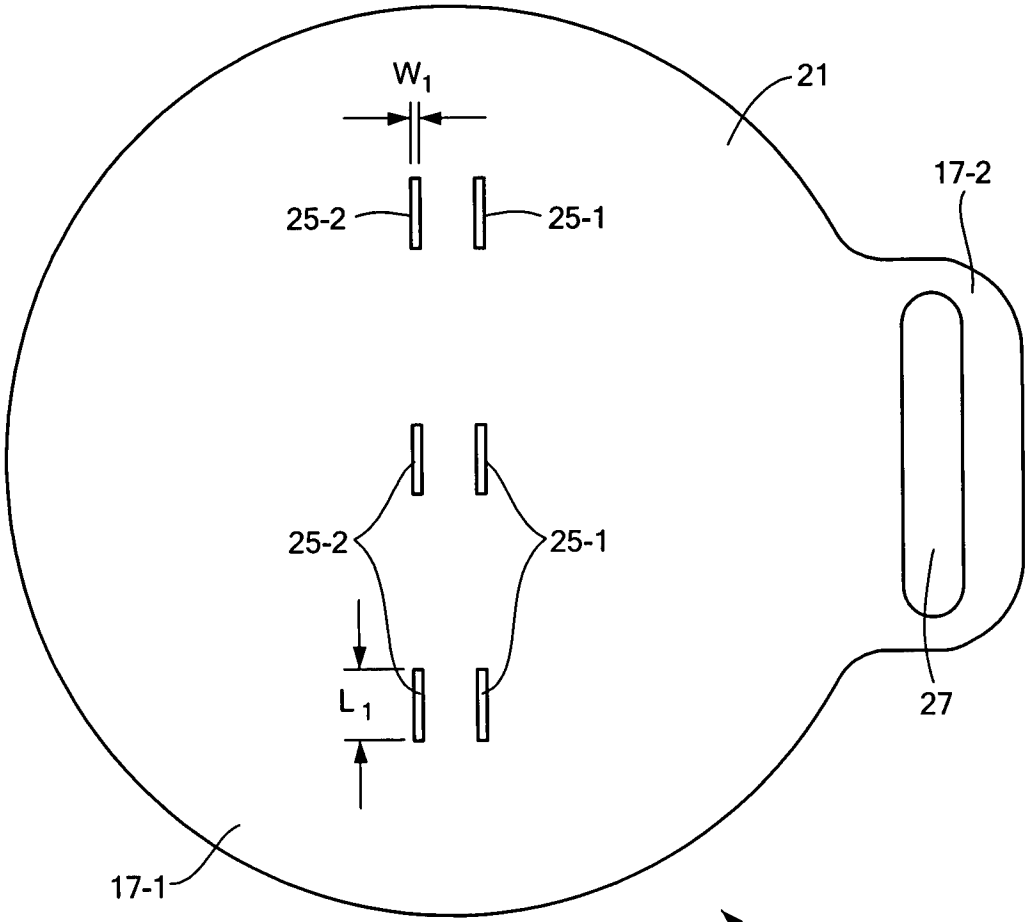

Referring now to FIGS. 2(*a*) and 2(*b*), base 17 is preferably formed as a unitary member that is constructed out of a rigid and durable material, such as a lightweight aluminum, plastic or composite thereof. Base 17 includes a generally flat top surface 21 and a generally flat bottom surface 23 that together provide base 17 with a uniform thickness $T_1$ of approximately 0.19 inches.

As seen most clearly in FIG. 2(*a*), base 17 includes an enlarged, generally disc-shaped portion, 17-1 that has a diameter $D_1$ of approximately 14.00 inches. A first series of three, spaced apart co-linear slots 25-1 extend transversely across portion 17-1. Similarly, a second series of three, spaced apart co-linear slots 25-2 extend transversely across portion 17-1 in a generally parallel relationship relative to first series of slots 25-1. Each slot 25 has a length $L_1$ of approximately 1.01 inches and a width $W_1$ of approximately 0.13 inches. As will be described further below, slots 25 are designed to receive complementary tabs formed on bracket 19 to facilitate assembly.

Base 17 is additionally shaped to include a rounded rectangular flange-shaped portion 17-2 that extends rearwardly from disc-shaped portion 17-1. Flange-shaped portion 17-2 is shaped to define an elongated transverse slot 27 that is dimensioned to receive a plurality of fingers. In this capacity, it is to be understood that portion 17-2 serves as an integral handle for carrying training device 11, which is highly desirable.

As seen most clearly in FIGS. 1(*a*), 1(*b*) and 1(*d*), elongated rectangular mounting bracket, or fulcrum, 19 has an inverted U-shape in transverse cross-section. Mounting bracket 19 extends transversely across top surface 21 of base 17 along its center line and includes a plurality of rectangular tabs (not shown) that are dimensioned to fittingly protrude into slots 25. The rectangular tabs on mounting bracket 19 are then permanently secured to base 17 by any conventional means (e.g., by spot welding the tabs on mounting bracket 19 to the portion of base 15 that immediately defines slots 25). With bracket 19 assembled to base 17, a laterally extending channel 29 is defined therebetween, the function of channel 29 to become apparent below.

Referring back to FIGS. 1(*a*)-(*d*), plate assembly 15 comprises a balance plate 31 that is pivotally coupled to bracket 19 and an angled top plate 33 that is removably mounted onto balance plate 31.

Figure 3A:
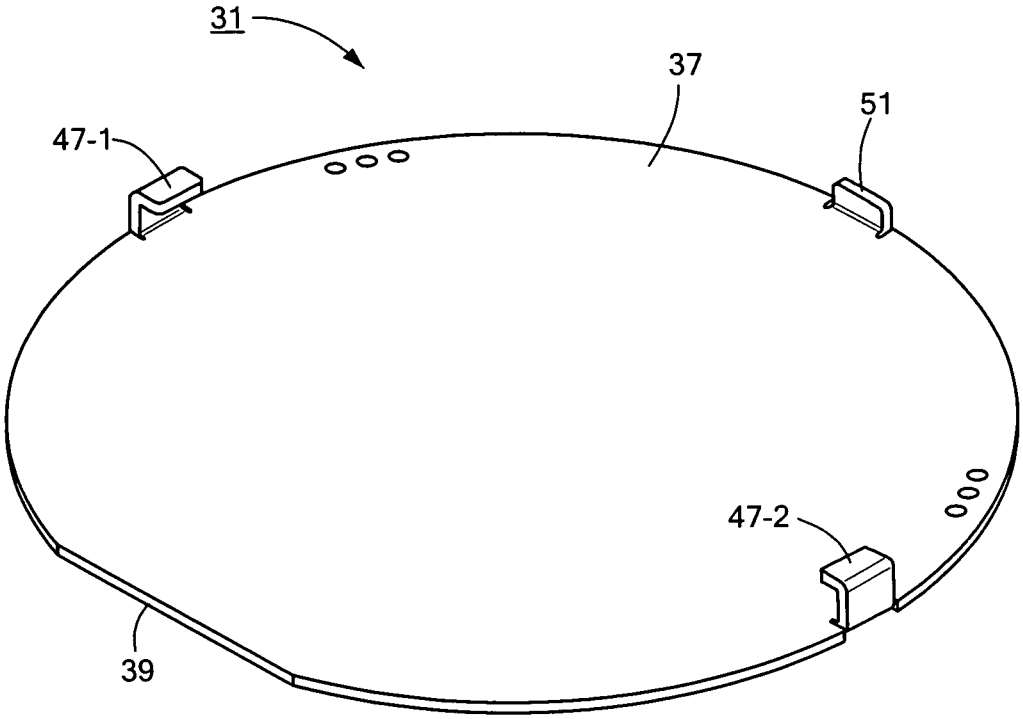
FIGS. 3(*a*)-(*c*) are bottom perspective, rear plan and bottom plan views, respectively, of the balance plate shown in FIG. 1(*a*)
Figure 3B:
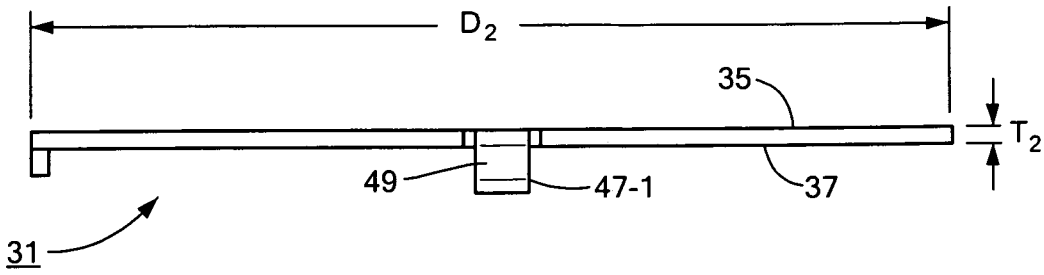
Figure 3C:
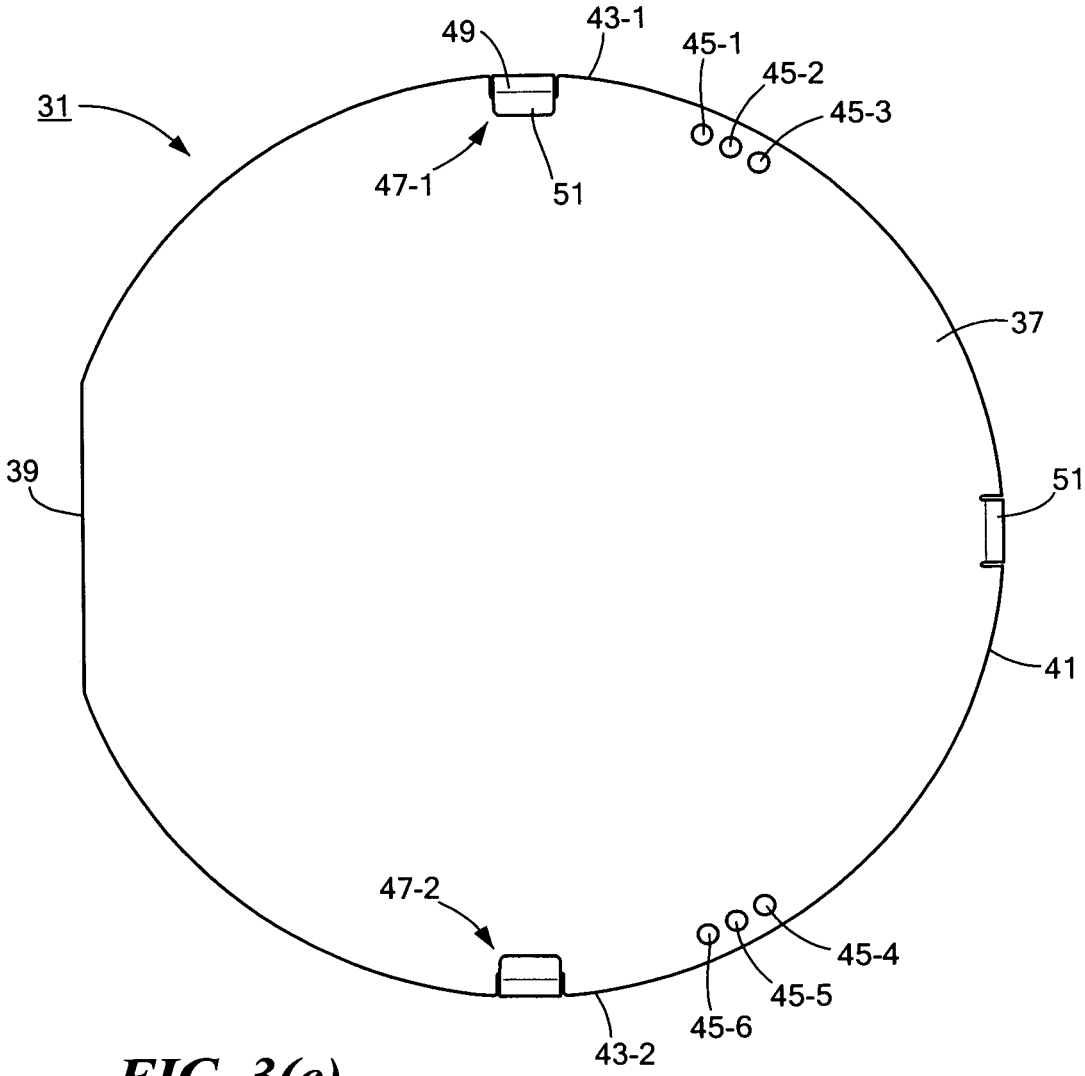

Balance plate 31, which is shown in isolation in FIGS. 3(*a*)-(*c*), is a unitary piece that is preferably constructed of a rigid and durable material, such as a lightweight aluminum, plastic or composite thereof. Balance, or standing, plate 31 is represented herein as an enlarged, generally disc-shaped member that is shaped to include a substantially flat top surface 35, a substantially flat bottom surface 37, a straightened front end 39, a rounded rear end 41 and a pair of opposing rounded sides 43-1 and 43-2.

As seen most clearly in FIG. 3(*c*), a first series of transverse holes 45-1 thru 45-3 extends vertically through balance plate 31 and is arranged as an arcuate array along the outer periphery of balance plate 31 between rear end 41 and left side 43-1, the first series of holes 45-1 thru 45-3 being spaced in approximately 0.37 inches from the outer periphery of balance plate 31 and fanned out approximately 4 degrees apart from one another in relation to the center point of balance plate 31. Similarly, a second series of transverse holes 45-4 thru 45-6 extends vertically through balance plate 31 and is arranged as an arcuate array along the outer periphery of balance plate 31 between rear end 41 and right side 43-2, the second series of holes 45-4 thru 45-6 being spaced in approximately 0.37 inches from the outer periphery of balance plate 31 and fanned out approximately 4 degrees apart from one another in relation to the center point of balance plate 31. Each hole 45 is generally circular in transverse cross-section and has a diameter of approximately 0.26 inches. As will be described further below, holes 45 are designed to fittingly receive corresponding posts on angled top plate 33 to facilitate connection.

Balance plate 31 preferably has a diameter $D_2$ of approximately 13.00 inches and a thickness $T_2$ of approximately 0.19 inches. As such, balance plate 31 is appropriately dimensioned to teeter on bracket 19 and, in turn, support the rear hitting foot of a variety of different sized users. However, it is to be understood that balance plate 31 is not limited to the particular size and/or shape set forth above. Rather, the particular configuration and/or dimensions of balance plate 31 could be modified without departing from the spirit of the present invention.

Balance plate 31 is shaped to include a pair of opposing retention arms 47-1 and 47-2 that are integrally formed onto sides 43-1 and 43-2, respectively. Each retention arm 47 is generally L-shaped in transverse cross-section and includes an upper portion 49 that extends orthogonally down from bottom surface 37 approximately 0.68 inches and a lower portion 51 that extends orthogonally inward from the free end of upper portion 49 approximately 0.56 inches. As will be described further in detail below, L-shaped retention arms 47 engage support member 15 to keep balance plate 31 loosely coupled thereto.

Balance plate 31 is additionally shaped to include a negative feedback projection, or kick stand, 51 that is integrally formed onto rear end 41. Projection 51 is represented herein as a rectangular tab, approximately 0.37 inches in length, that extends orthogonally down from bottom surface 21 at rear end 25. It should be noted that the spacing S between bottom surface 37 of balance plate 31 and top surface 21 of base 17 is approximately 0.74 inches. Accordingly, it is to be understood that shortened projection 51 is sized and shaped to extend only a portion (approximately one-half) of the distance between bottom surface 37 of balance plate 31 and top surface 21 of base 17, as seen most clearly in FIG. 1(*b*). In this capacity, projection 51 is designed to contact top surface 21 of base 17 upon any limited rearward teetering of balance plate 31 on support member 13, thereby providing the user with detectable feedback that he has engaged in a rearward weight shift. Because rearward weight shift is an undesirable component of the proper hitting technique, projection 51 is referred to herein as providing "negative feedback" to the user.

Figure 4A:
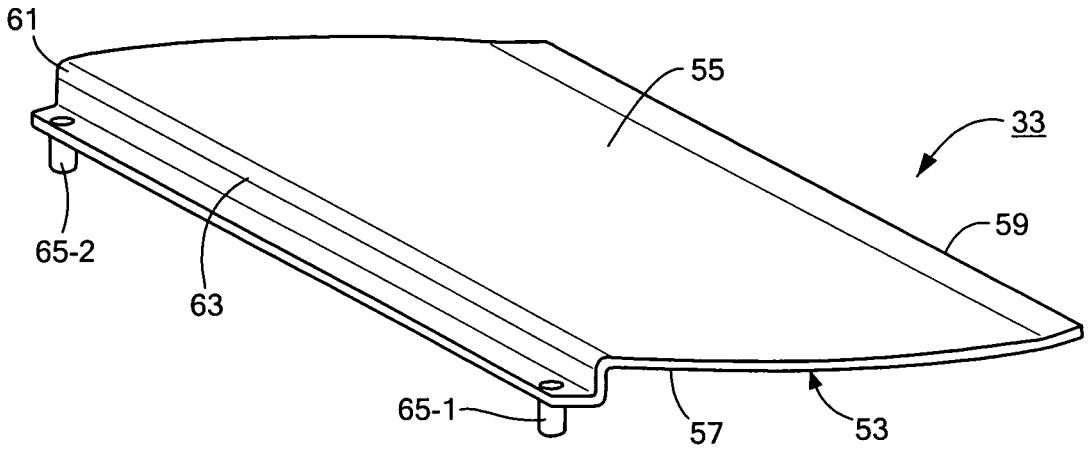
FIG. 4(*a*) is a rear perspective view of the top plate shown in FIG. 1(*a*)
Figure 4B:
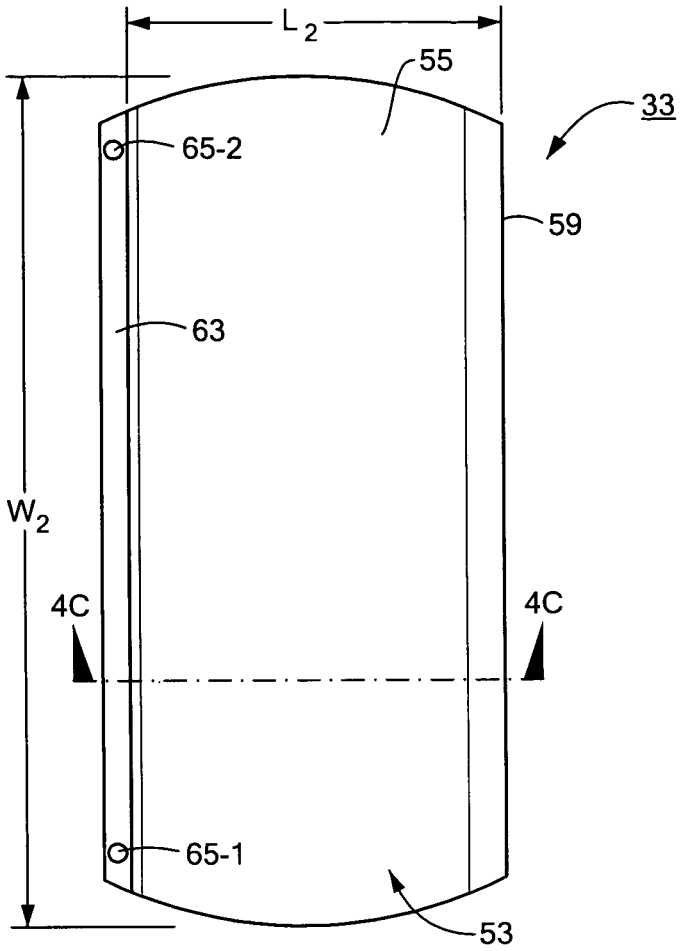
Figure 4C:
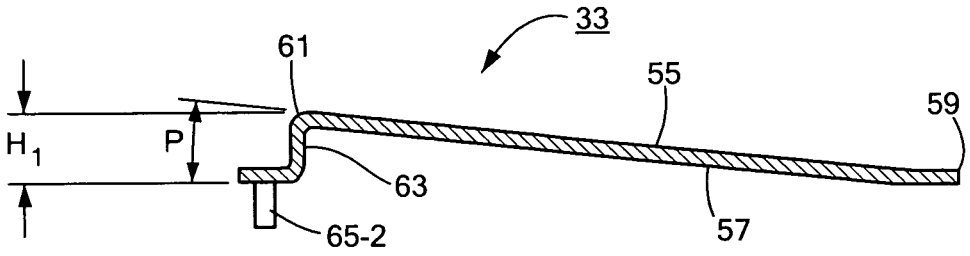

As noted above, angled top plate 33 is removably mounted onto top surface 19 of balance plate 31. Top plate 33, shown in isolation in FIGS. 4(*a*)-(*c*), is a unitary member that is preferably constructed of a rigid and durable material, such as lightweight aluminum, plastic or a composite thereof. Top plate 33 includes a generally flat foot support portion 53 that includes a top surface 55, a bottom surface 57, a front edge 59 and a rear edge 61. As seen most clearly in FIG. 4(*b*), foot support portion 53 is generally rectangular in shape and has a length $L_2$ of approximately 6.00 inches and a maximum width $W_2$ of approximately 13.00 inches. Accordingly, it is to be understood that top surface 55 of portion 53 is dimensioned to receive the rear foot of a hitter when positioned transversely thereon, as will be described further below.

An L-shaped flange 63 is integrally formed along rear edge 61 and extends orthogonally downward therefrom. As such, flange 63 provides top plate 33 with its angled profile. Specifically, flange 63 lifts rear edge 61 a height $H_1$ of approximately 0.55 inches above top surface 19 of balance plate 31. As such, top surface 55 of portion 53 has a slight rearward pitch P of approximately 5.16 degrees.

It should be noted that the aforementioned pitch of top plate 33 serves to dispose the user's rear foot at a similar angle. This inward angle applied to the user's rear foot naturally encourages the hitter to maintain the majority of his body weight on the inner portion of the rear foot when in the proper load position. As a result, top plate 33 serves, inter alia, to promote inner rear loading, which is highly desirable.

A pair of downwardly projecting pins, or posts, 65-1 and 65-2 are integrally formed onto opposing sides of the free end of L-shaped flange 63. As noted briefly above, pins 65 are dimensioned to fittingly project into complementary holes 45 in balance plate 31 to secure top place 33 thereto.

In FIG. 1(*a*), pins 65-1 and 65-2 are shown penetrating through center holes 45-2 and 45-5, respectively. Disposed as such, the longitudinal axis $LA_1$ of top plate 33 extends in an orthogonal relationship relative to the longitudinal axis $LA_2$ of base 17. As a result, the rear foot of the hitter, when placed properly upon top plate 33, would extend in a neutral position (i.e., would point at a right angle relative to the direction of the pitcher).

However, it is to be understood that top plate 33 could rotated in the counterclockwise direction so that pins 65-1 and 65-2 penetrate through holes 45-3 and 45-6, respectively. Disposed as such, the longitudinal axis $LA_1$ of top plate 33 extends in a non-orthogonal relationship relative to the longitudinal axis $LA_2$ of base 17. As a result, the rear foot of a right-handed hitter, when placed properly upon top plate 33, would extend in a slightly forward position (i.e., would point slightly in the direction towards the pitcher). To similarly accommodate left-handed hitters who prefer a rear foot position that points slightly forward, top plate 33 could be rotated in the clockwise direction so that pins 65-1 and 65-2 penetrate through holes 45-1 and 45-4, respectively.

With device 11 in its fully assembled form, bottom surface 37 of balance plate 31 lies directly on the flattened top surface of mounting bracket 19, as seen most clearly in FIGS. 1(*a*)-(*d*). Furthermore, the free ends of retention arms 47 project into opposite ends of channel 29 to permanently couple plate assembly 15 to support member 13 (i.e., preclude vertical or lateral separation of components).

It should be noted that device 11 is designed such that there is considerable clearance (i.e., spacing) between retention arms 47 and mounting bracket 19 when balance plate 31 lies in its natural horizontal orientation. As a result of this loose coupling, balance plate 31 is capable of teetering forward or rearward on bracket 19 (i.e., with mounting bracket 19 serving as the fulcrum, or balance point, about which balance plate 31 is able to pivot relative to base 17).

Device 11 can be used in the following manner to train a hitter to initiate the hitting process by driving the powerful muscles of the hitter's lower body forward along a generally linear path (i.e., using a linear power move). As part of the set-up process, the operator first positions flat bottom surface 23 of base 17 on the appropriate flooring surface and orientates device 11 such that front end 23 of balance plate 17 is directed forward towards the intended target (e.g., the pitcher).

It should be noted that device 11 is designed for placement upon any relatively flat flooring surface (e.g., dirt mound, real or artificial grass field, cement basement, etc.). As a result, device 11 can be used frequently in a wide variety of environments, which is highly desirable.

Figure 5A:
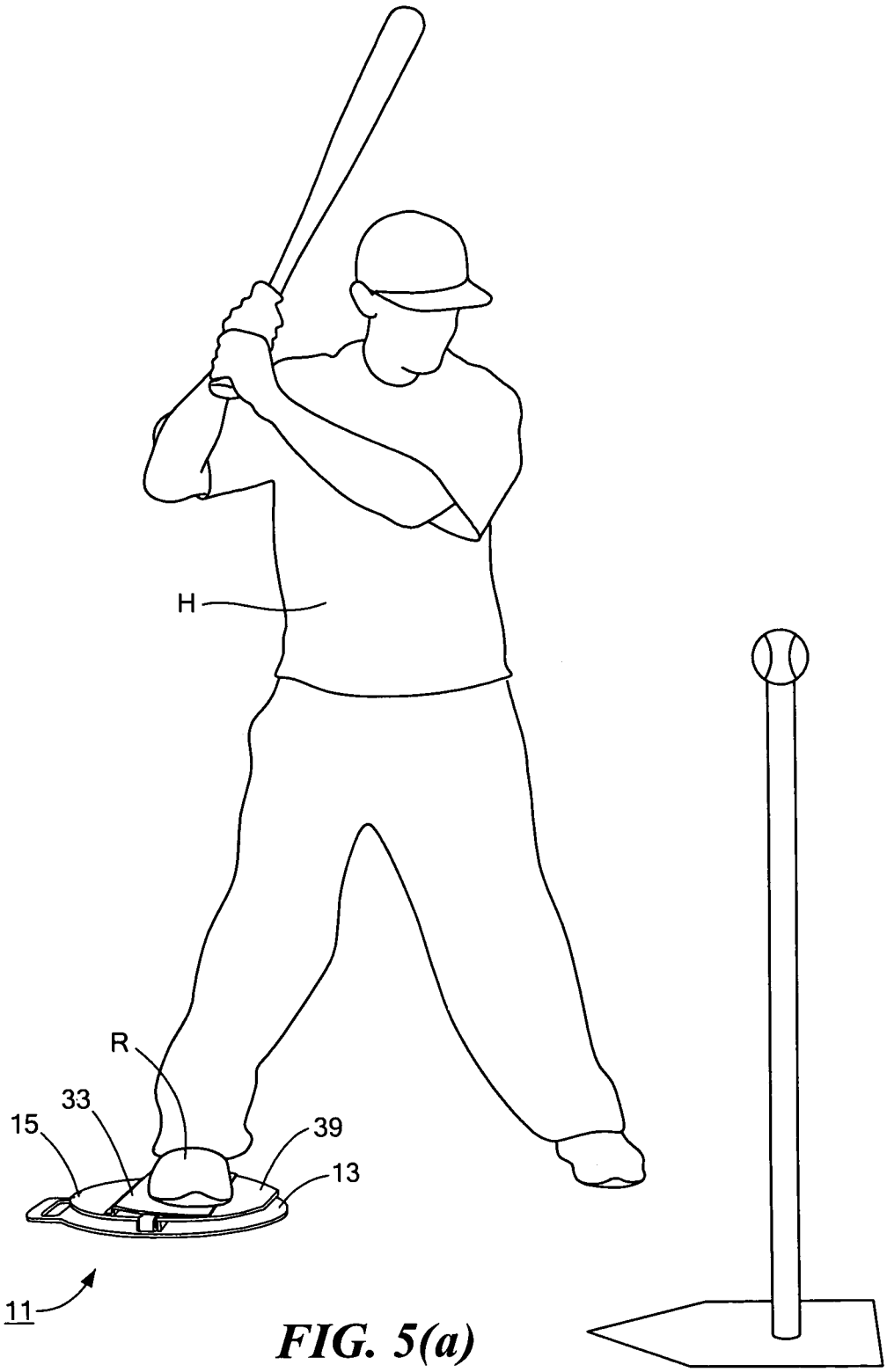
FIGS. 5(*a*)-(*c*) are top perspective views of the training device shown in FIG. 1(*a*), the training device being shown in use at various stages of the hitting process.
Figure 5B:
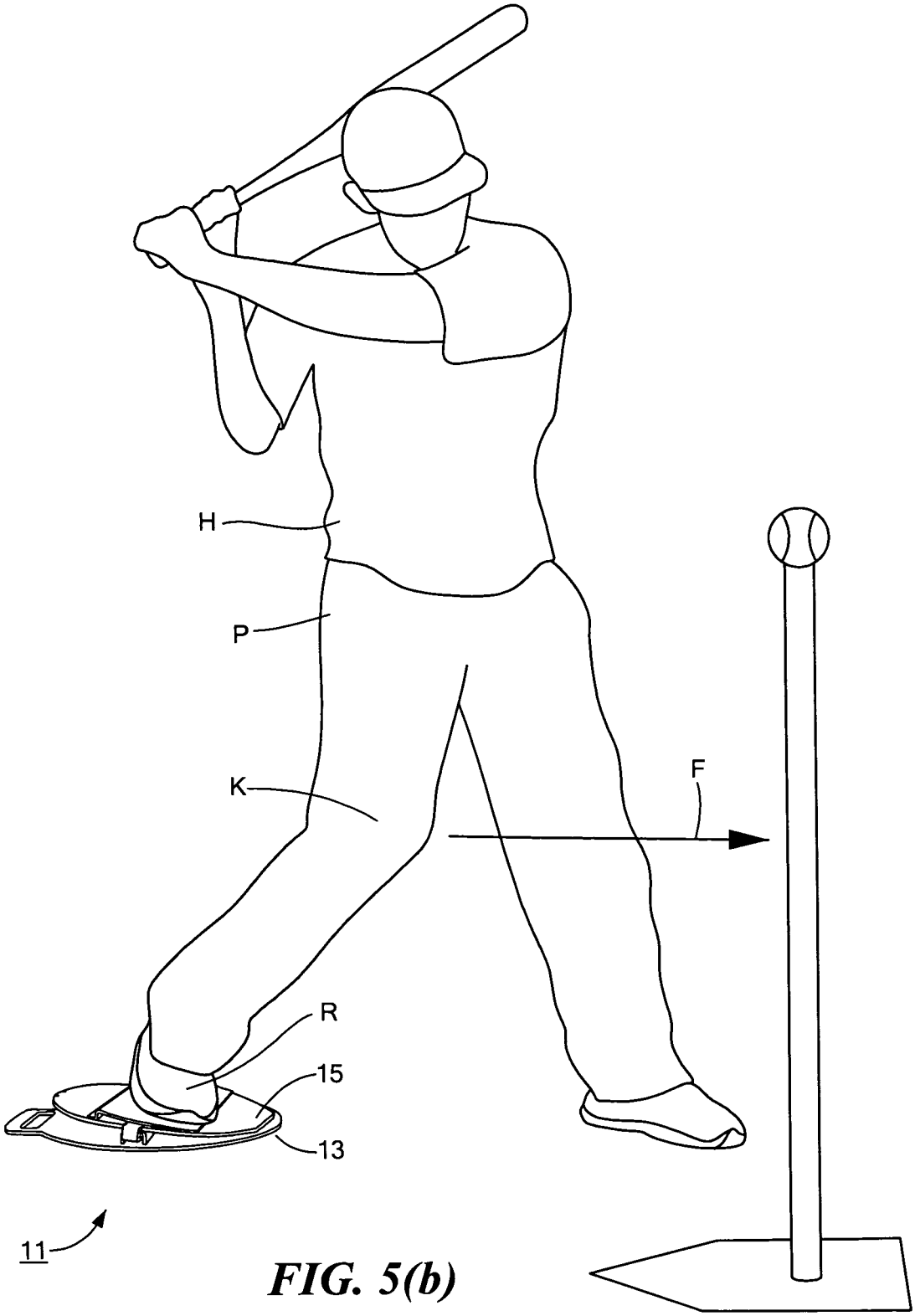
Figure 5C:
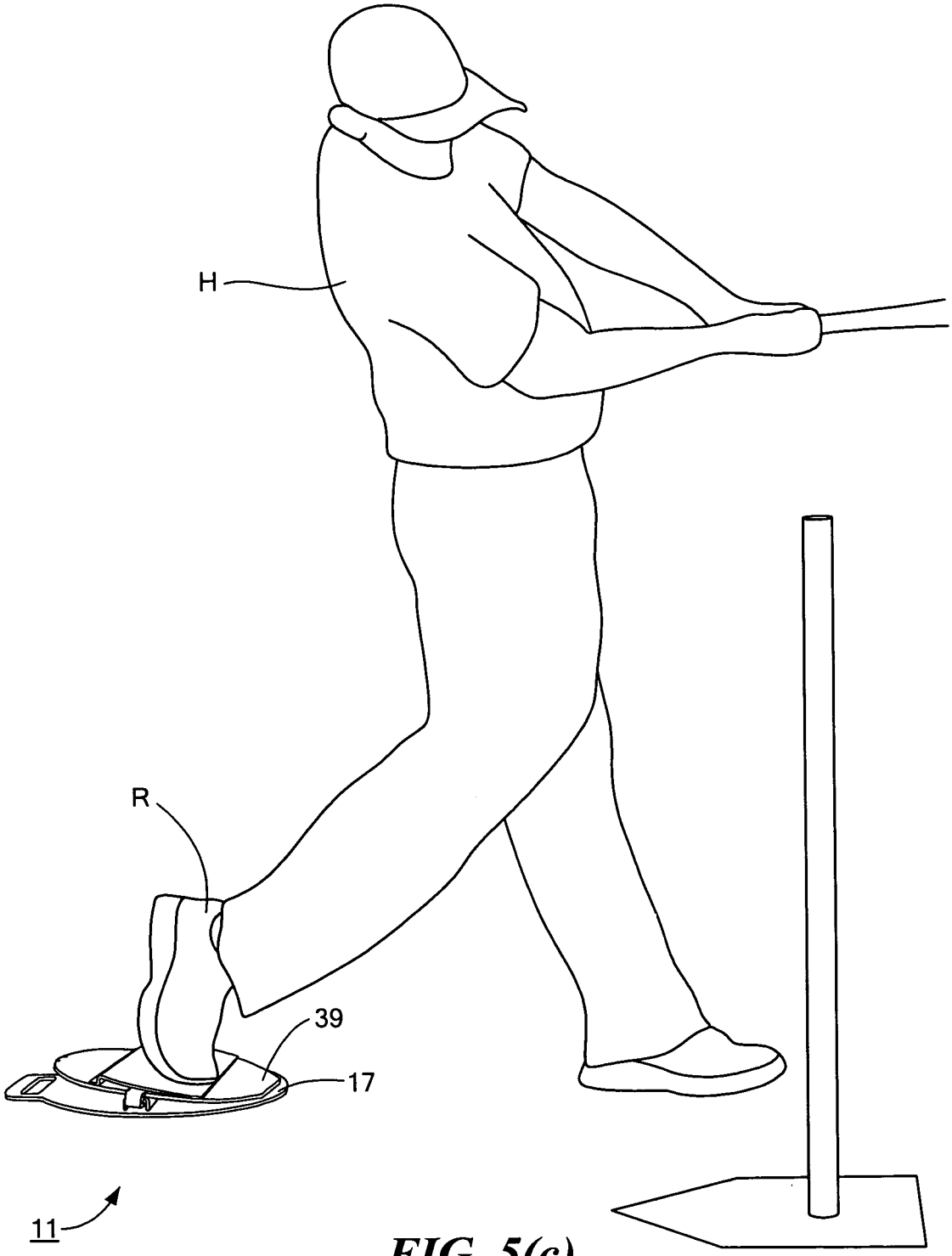

With training device 11 positioned as such, the operator can commence the hitting training process. Referring now to FIGS. 5(*a*)-(*c*), device 11 is shown being used by a hitter H at various stages during a technically proper baseball swing. In the first step, the rear foot R (i.e., the right foot for a right-handed hitter) of hitter H is positioned transversely across top surface 55 of top plate 33 (i.e., with toes of a right-handed hitter pointed towards side 43-2 and arch directed towards front end 39). The front foot is then positioned on the ground directly in front of device 11.

With hitter H positioned sideways, eyes directed forward and body coiled so as to hold the hands (and bat) behind the hitting zone, hitter H initially adjusts his body so that his center of gravity aligns with the inner portion of his rear leg, with angled top plate 33 promoting proper body disposition. In this capacity, the majority of the weight of hitter H is effectively loaded in the inner portion of the rear hip, leg and foot. With the weight of the hitter properly distributed as such, balance plate 15 remains horizontally disposed relative to support member 13, as seen in FIG. 5(*a*).

To initiate the hitting process, hitter H drives his lower body linearly forward, as represented by arrow F in FIG. 5(*b*), this movement being typically accompanied by a forward slide of the front foot. This linear power move transfers the majority of the weight of hitter H linearly forward, with the rear hip P and knee K of hitter H advancing in front of rear foot R, as shown. When completed properly, the linear power move causes balance plate 15 to pivot forward until front end 39 of balance plate 15 strikes top surface 21 of base 17.

It should be noted that the aforementioned weight transfer causes balance plate 15 to contact base 17 with a significant amount of force which, in turn, creates a substantial auditory signal (e.g., a load metal clanking noise). In addition, the forward articulation of balance plate 15 provides hitter H with a sensory reaction (i.e., the sensation of teetering forward). Accordingly, it is to be understood that hitter H is instantly provided with both auditory and tactile feedback from device 11 that the magnitude and timing of the linear power move has been properly executed, which is a principal object of the present invention. Completion of the linear power move results in hitter H disposed in the attack position shown in FIG. 5(*b*).

The considerable lower body momentum initiated through the linear component then powers, or transitions into, the rotational component. Specifically, the acceleration of the body weight linearly forward powers the rapid rotation of the hips, torso, shoulders, arms and hands of hitter H as part of a kinetic chain of movement. This rapid rotation drives the bat through the hitting zone with considerable acceleration and power, as shown in FIG. 5(*c*).

As such, it is to be understood that device 11 is well-suited to train a hitter how to utilize powerful leg muscles to transfer weight linearly forward which, in turn, creates momentum that drives, or powers, the rotational component of the baseball swing. In addition, device 11 can be used to detect fundamental hitting flaws that can significantly compromise performance.

As an example, an initial rearward weight shift is a common hitting flaw that can significantly compromise performance. Using training device 11 in the manner set forth above, any initial rearward weight transfer causes balance plate 15 to pivot backward which, in turn, causes kick stand 51 to strike base 17 with enough force to create an auditory signal. In this manner, training device 11 provides the hitter with immediate negative feedback.

As another example, hitters often fail to execute the linear component of a proper swing and, as such, rely entirely upon the upper body based rotational component to generate power. In this situation, the lower body of the hitter twists, or spins, and is therefore is largely inactive in supplying power to the swing. Using training device 11 in the manner set forth above, the lack of an auditory or tactile response upon initiation of the hitting process immediately notifies the user of a lack and/or mistimed lower body drive.

The embodiment shown of the present invention is intended to be merely exemplary and those skilled in the art shall be able to make numerous variations and modifications to them without departing from the spirit of the present invention. All such variations and modifications are intended to be within the scope of the present invention as defined in the appended claims.

What is claimed is:

1. A training device, comprising:

(a) a plate assembly, the plate assembly comprising, (i) a balance plate comprising a flattened top surface, a flattened bottom surface, a front end, a rear end and a pair of opposing sides, and (ii) a top plate removably mounted onto the top surface of the balance plate; and (b) a support member to which the balance plate is pivotally coupled, the plate assembly being naturally biased to balance on the support member along a generally horizontal plane in the absence of a force applied thereto;

(c) wherein at least a portion of the top profile of the plate assembly lies in a non-parallel relationship relative to the generally horizontal plane when the plate assembly is balanced on the support member.

2. The training device as claimed in claim 1 wherein the top plate includes a support portion comprising a top surface, a bottom surface, a front edge and a rear edge.

3. The training device as claimed in claim 2 wherein the top surface of the support portion extends at an acute angle relative to the top surface of the balance plate when the top plate is mounted on the balance plate.

4. The training device as claimed in claim 3 wherein the top surface of the support portion extends at an approximately 5 degree angle relative to the top surface of the balance plate when the top plate is mounted on the balance plate.

5. The training device as claimed in claim 3 wherein a first series of transverse holes is formed into the top plate.

6. The training device as claimed in claim 5 wherein the top plate comprises a first downwardly protruding pin, the first pin being dimensioned to fittingly protrude through at least one of the first series of holes in the top plate.

7. The training device as claimed in claim 6 wherein the top plate is adapted to be mounted onto the balance plate in a plurality of different positions by inserting the first pin into each of the first series of holes.

8. The training device as claimed in claim 7 wherein a second series of transverse holes is formed into the top plate.

9. The training device as claimed in claim 8 wherein the top plate additionally comprises a second downward protruding pin, the second pin being dimensioned to fittingly protrude each of the second series of holes in the top plate.

10. The training device as claimed in claim 1 wherein the plate assembly is adapted to teeter in both the forward and rearward direction.

11. The training device as claimed in claim 10 further comprising a downwardly extending projection formed onto rear end of balance plate, the projection being spaced apart from the support member when the plate assembly is balanced on the support member, the projection being dimensioned to selectively contact the support member when plate assembly teeters in the rearward direction.

12. The training device as claimed in claim 1 wherein the plate assembly further includes a pair of opposing retention arms that engage the support member to keep plate assembly coupled thereto.

13. The training device as claimed in claim 12 wherein the support member comprises:

(a) an enlarged base having a top surface and a bottom surface, and (b) a transverse mounting bracket formed on the top surface of the base, (c) wherein the bottom surface of the balance plate is mounted the transverse mounting bracket and is adapted to teeter thereon.

14. The training device as claimed in claim 13 wherein the base is shaped to define an elongated slot for holding the training device.

* * * * *